US006935538B1

(12) United States Patent
Stelcher

(10) Patent No.: US 6,935,538 B1
(45) Date of Patent: Aug. 30, 2005

(54) ANTI-CLOG SHAKER SYSTEM

(75) Inventor: William Stelcher, Sarasota, FL (US)

(73) Assignee: Kinetronics Corporation, Sarasota, FL (US)

( * ) Notice: Subject to any disclaimer, the term of this patent is extended or adjusted under 35 U.S.C. 154(b) by 0 days.

(21) Appl. No.: 10/787,475

(22) Filed: Feb. 26, 2004

(51) Int. Cl.[7] ..... B65D 83/00
(52) U.S. Cl. ..... 222/196.3; 222/196.5; 222/565
(58) Field of Search ..... 222/196, 196.1, 222/196.2, 196.3, 196.5, 565; 366/244, 247

(56) References Cited

U.S. PATENT DOCUMENTS 1,231,761 A * 7/1917 Lofstrom ..... 222/196.3
1,389,443 A * 8/1921 Freedline ..... 222/196.3
1,970,891 A * 8/1934 King ..... 222/196.3
2,479,811 A * 8/1949 Calise ..... 222/196.3
2,656,076 A * 10/1953 Von Essen ..... 222/196.3
3,478,932 A * 11/1969 Phillips ..... 222/192

* cited by examiner

*Primary Examiner*—Joseph A. Kaufman
(74) *Attorney, Agent, or Firm*—Schiff Hardin LLP

(57) ABSTRACT

An anti-clog shaker system and method utilizes a shaker container and a cap attached to the shaker container. The cap has a surface with a plurality of apertures through which particles contained within the container will pass when the shaker container is inverted and shook. An agitator is provided comprising a shank having at least one protruding element. As the agitator is rotated, the agitator breaks up particles in the container. A winder is connected to the agitator. A wiper element is also connected to the agitator so that as the winder is rotated to rotate the agitator, the wiper element also wipes away particles which may adhere in a region at the apertures of the shaker cap.

19 Claims, 1 Drawing Sheet

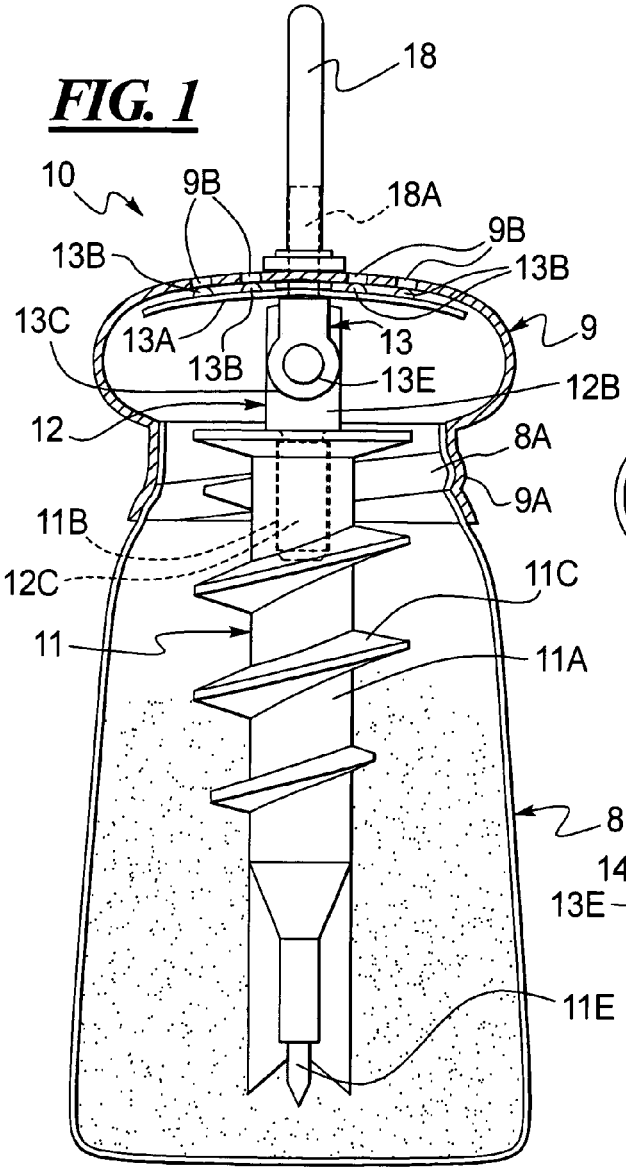
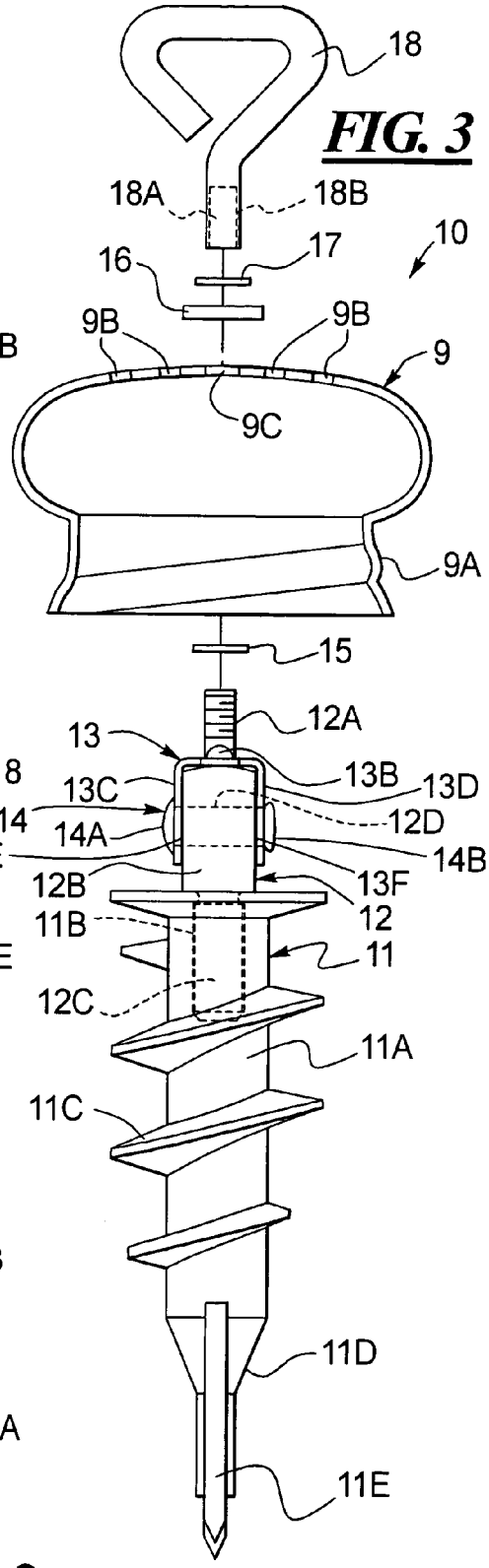
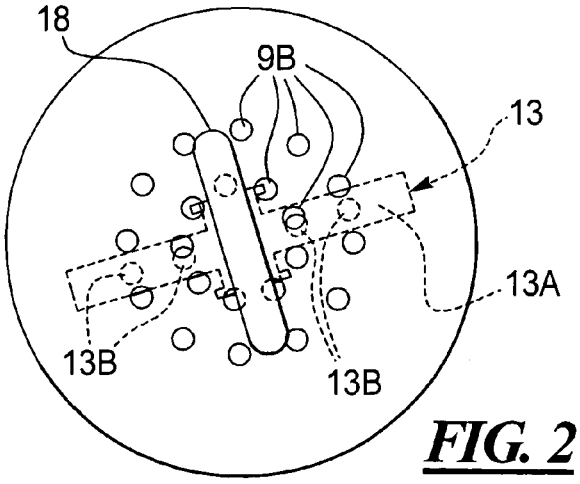
FIG. 2

ANTI-CLOG SHAKER SYSTEM

BACKGROUND

When salt shakers, grated cheese shakers, or other types of food supplements in the nature of granular or flake particles are provided in shakers, moisture can cause the particles to adhere to one another, thus impeding exit of those particles when the shaker is inverted. Typically, shakers have covers which may be fastened by screw threads or the like onto the top of the shaker container, and a plurality of apertures, typically in a grid-like pattern, are provided in the cover. The particles within the shaker when they bind together to one another are precluded from passing through the apertures when the shaker is inverted and shook.

SUMMARY

It is an object to solve the above-mentioned problem.

An anti-clog shaker system and method is provided wherein a shaker container has a cap, and the cap has a surface with a plurality of apertures through which particles which are to be contained within the container will pass when the shaker container is inverted. An agitator comprising a shank having at least one protruding element, rotates to break up particles in the shaker container. A winder is connected to the flexible agitator for rotating the mixer. A wiper element is connected to the agitator so that as the winder is rotated to rotate the agitator, the wiper element also wipes away particles which may adhere in the region at the apertures of the shaker cap.

BRIEF DESCRIPTION OF THE DRAWINGS

FIG. 1 is a side view of the shaker container and cap cut-away to show the anti-clog shaker system;

FIG. 2 is a top view showing a wiper of the anti-clog shaker system; and

FIG. 3 is an exploded side view of the anti-clog shaker system with the shaker container removed for viewing ease.

DESCRIPTION OF THE PREFERRED EMBODIMENT

For the purpose of promoting an understanding of the principles of the invention, reference will now be made to a preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

FIG. 1 generally illustrates at 10 the anti-clog shaker system. The shaker system comprises a shaker container 8 typically having screw threads 8A or some other connection system for receiving or attaching to a shaker cap 9 having connection threads 9A for mating with the connection threads 8A of the container. Of course, alternative forms of attachment between the cap and the container may also be provided.

Shaker cap 9 has a plurality of apertures or slots such as 9B typically arranged in a pattern. Frequently, the shaker cap 9 is dome-shaped, although it might be flat or have other slopes.

The container 8 typically contains granular, flaky, or other various shaped particles such as salt, grated cheese, or other types of food additives or the like. In humid conditions or for other reasons, these particles may stick to one another, preventing or limiting discharge of the particles from the shaker when the shaker is inverted and shook.

As shown in FIGS. 1 and 3, an anti-clog mechanism which is part of the anti-clog shaker system comprises at the leading penetrating end of the mechanism an agitator 11 preferably formed of plastic and having a shank 11A, a threaded hole 11B in one end face, and a flat planar tip 11E with a tri-point termination for penetrating into the particles at the end of the shank 11A. A tapering portion 11D provides a transition surface to the tip 11E from cylindrical portion of the shank 11A. The shank 11A also has a grinding screw-like thread 11C at the periphery of the shank 11A.

A winder stud 12 has a central cylindrical portion 12B with a threaded first attachment element 12A at one end and a second threaded attachment element 12C at an opposite end of the central portion 12B. The threaded attachment element 12C threadedly engages with the threaded hole 11B of the shank 11A.

Attached to the central portion 12B is a wiper element 13 having a wiper blade 13A as shown most clearly in FIG. 2. The wiper blade 13A has projecting dimples 13B which rub against, or in close proximity, to a bottom surface of the cap 9 where the apertures 9B are located.

The wiper element 13 also has bent ears 13C and 13D serving as mounting flanges. These flanges or ears have respective apertures 13E, 13F for receiving a rivet 14 having a head 14A and a flared-out portion 14B. Rivet 14 is received through aperture 12D in central portion 12B of winder stud 12.

The first attachment element 12A receives thereover a nylon washer 15, and passes through an aperture 9C in the shaker cap 9, through a nylon washer 16, and then through nylon washer 17. The first attachment element 12A is threadedly engaged with threads 18A of a hole 18B at an attachment end of a winder 18. Other methods of attachment may be employed between the winder 18 and the winder stud 12.

Preferably the washer 16 is nylon, the rivet 14 is stainless steel, and the winder 18 is a bent metal rod or wire. In the preferred embodiment, the winder 18 is formed in an inverted triangle shape to serve as a handle.

In the preferred embodiment, the anti-clog shaker system comprises a salt shaker. When the winder 18 is turned, the wiper blade 13A rotates so that the dimples 13B clear out adhered particles in the region of the apertures 9B. At the same time, as the agitator 11 rotates, it breaks up particles, such as salt particles, and allows them to freely flow when the shaker container 8 is inverted and shook. Thus the particles may then freely pass through the apertures in shaker cap 9.

Although the agitator is shown as having a screw thread on the shank, the agitator may take other forms for breaking up the particles when the mixer is rotated, such as providing projecting elements from the shank.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

I claim as my invention:

1. An anti-clog shaker system, comprising:

a shaker container;

a cap attached to the shaker container, said cap having a surface with a plurality of apertures through which particles which are to be contained within the container will pass when the shaker container is inverted and the shaker is shook;

an agitator comprising a shank having at least one protruding element which, when the agitator is rotated, will break up the particles to be contained in the shaker container;

a winder connected to the agitator through an aperture in the shaker cap; and a wiper element connected to the agitator so that as the winder is rotated to rotate the mixer the wiper element also wipes away particles which may adhere in a region at the apertures of the shaker cap.

2. The system of claim 1 wherein the protruding element on the agitator comprises a screw-like thread at a periphery of the shank.

3. The system of claim 1 wherein the agitator has a flat planar tip.

4. The system of claim 1 wherein the wiper element comprises a wiper blade having a plurality of projecting dimples.

5. The system of claim 1 wherein the wiper element comprises a wiper blade having projections.

6. The system of claim 1 wherein the wiper element comprises a wiper blade and bent ears serving as mounting flanges mounted to a winder stud, the winder stud connecting the winder to the agitator.

7. The system according to claim 1 wherein the winder is connected to the agitator by a winder stud.

8. The system according to claim 7 wherein the winder stud comprises a central cylindrical portion with a threaded first attachment element at one end and a threaded second attachment element at an opposite end, the first and second threaded attachment elements being respectively received in a respective threaded hole of the winder and of the agitator.

9. The system of claim 8 wherein a washer is provided around the threaded first attachment element between the winder stud central cylindrical portion and a bottom of the cap.

10. The system of claim 8 wherein two washers are provided around the threaded first attachment element between an outer surface of the cap and an attachment end of the winder.

11. The system according to claim 1 wherein the winder comprises a rod bent at one end to form a handle.

12. The system according to claim 11 wherein the handle is bent into a triangular shape.

13. The system according to claim 1 wherein a winder stud connects the winder to the agitator, the winder stud connecting to said wiper element by mounting flanges, and a rivet holding the mounting flanges to the winder stud.

14. An anti-clog shaker system, comprising:

a shaker container;

an end surface at one end of the shaker container with a plurality of apertures through which particles which are to be contained within the container will pass when the shaker container is inverted and the shaker is shook;

an agitator which, when the agitator is rotated, will break up the particles to be contained in the shaker container;

a winder connected to the agitator through an aperture in the end surface; and a wiper element connected to the agitator so that as the winder is rotated to rotate the agitator the wiper element also wipes away particles which may adhere in a region at the apertures of the shaker cap.

15. An anti-clog shaker mechanism, comprising:

a shaker container having an end surface with a plurality of apertures;

an agitator which, when the agitator is rotated, will break up the particles to be provided in the shaker container;

a winder connected to the agitator through an aperture in the shaker container end surface having said plurality of apertures; and a wiper element connected to the agitator so that as the winder is rotated to rotate the agitator the wiper element also wipes away particles which may adhere in a region at the apertures of the shaker end surface.

16. An anti-clog method for use with a shaker container having a cap, comprising the steps of:

providing the cap with a plurality of apertures through which particles which are to be contained within the container will pass when the shaker container is inverted and shook;

providing an agitator in the container which, when rotated, will break up particles to be provided in the shaker container;

providing a winder passing through an aperture in said cap to rotate the agitator;

providing a wiper element connected to the agitator so that as the winder is rotated to rotate the agitator the wiper element also wipes away particles which may adhere in a region at the apertures of the cap; and rotating the winder to rotate the agitator and wiper element and inverting and shaking the shaker container to cause the particles to pass through said apertures.

17. The method according to claim 16 including the step of providing protrusions on the wiper element so that as the winder is rotated, the protrusions wipe away particles which may adhere in a vicinity of said apertures of said cap while the agitator is breaking up particles in the shaker container.

18. The method according to claim 16 including the step of providing at least one protruding element on the agitator for breaking up the particles as the agitator is rotated.

19. The method according to claim 18 including the step of providing said protruding element as a screw thread at a periphery of a shank so that as the agitator is rotated, the screw thread will break up the particles in the shaker container.

* * * * *